US010480518B2

(12) United States Patent
Fullemann et al.

(10) Patent No.: US 10,480,518 B2
(45) Date of Patent: Nov. 19, 2019

(54) METHOD FOR CONTROLLING A PUMP ARRANGEMENT

(71) Applicant: XYLEM IP HOLDINGS LLC, White Plains, NY (US)

(72) Inventors: Alexander Fullemann, Stockholm (SE); Fredrik Soderlund, Stockholm (SE); Mats Karlen, Spanga (SE)

(73) Assignee: XYLEM IP HOLDINGS LLC, White Plains, NY (US)

( * ) Notice: Subject to any disclaimer, the term of this patent is extended or adjusted under 35 U.S.C. 154(b) by 966 days.

(21) Appl. No.: 14/367,982

(22) PCT Filed: Dec. 21, 2012

(86) PCT No.: PCT/US2012/071154
§ 371 (c)(1),
(2) Date: Jun. 23, 2014

(87) PCT Pub. No.: WO2013/096726
PCT Pub. Date: Jun. 27, 2013

(65) Prior Publication Data

US 2014/0369854 A1 Dec. 18, 2014

(30) Foreign Application Priority Data

Dec. 22, 2011 (SE) ..... 1151254

(51) Int. Cl.
*F04D 15/02* (2006.01)
*F04D 7/04* (2006.01)
(Continued)

(52) U.S. Cl.
CPC ..... *F04D 15/0254* (2013.01); *F04D 7/04* (2013.01); *F04D 13/08* (2013.01);
(Continued)

(58) Field of Classification Search
CPC ..... F04D 7/04; F04D 13/08; F04D 15/0066; F04D 15/0236; F04D 15/0254; F04D 29/708; F04D 15/0245
(Continued)

(56) References Cited

U.S. PATENT DOCUMENTS 5,221,189 A 6/1993 Henningsen
5,488,276 A * 1/1996 Nishibe ..... H02H 7/0851 318/282
(Continued)

FOREIGN PATENT DOCUMENTS

CN 1693711 A 11/2005
EP 2025943 A2 2/2009
(Continued)

OTHER PUBLICATIONS

Examination Report dated Jan. 19, 2017 for Chilean Application No. 2014-1631.
(Continued)

*Primary Examiner* — Philip E Stimpert
(74) *Attorney, Agent, or Firm* — Browdy and Neimark, PLLC

(57) ABSTRACT

A method for controlling a pump arrangement comprising a pump having a motor and a control unit. The motor, when the pump is in an active state and the motor is driven in a first direction, is associated with a load factor that corresponds to an operating condition of the pump arrangement. The pump arrangement also includes a unit configured to monitor at least one operating parameter from which the load factor of the motor can be derived. The method includes determining a real value of the at least one operating parameter, determining if an externally applied force is acting on the motor to such an extent that an operating condition detrimental to the pump arrangement is initiated, effecting a state shift from
(Continued)

the active state to an inactive state of the pump if an operating condition detrimental to the pump arrangement is initiated, the state shift including a step according to which the control unit, immediately after a detrimental operating condition is initiated, abruptly breaks the driving of the motor in the first direction.

20 Claims, 9 Drawing Sheets

(51) Int. Cl.
*F04D 15/00* (2006.01)
*F04D 29/70* (2006.01)
*F04D 13/08* (2006.01)

(52) U.S. Cl.
CPC ..... *F04D 15/0066* (2013.01); *F04D 15/0236* (2013.01); *F04D 29/708* (2013.01)

(58) Field of Classification Search
USPC ..... 417/44.11
See application file for complete search history.

(56) References Cited

U.S. PATENT DOCUMENTS 6,059,536 A * 5/2000 Stingl ..... A61H 33/6073 4/541.2
6,481,973 B1 * 11/2002 Struthers ..... F04D 7/045 417/36
7,348,744 B2 * 3/2008 Liao ..... H02H 7/0811 318/430
2004/0213676 A1 * 10/2004 Phillips ..... F04B 17/03 417/44.11
2005/0123408 A1 6/2005 Koehl et al.
2006/0090255 A1 * 5/2006 Cohen ..... E04H 4/12 4/509
2010/0034665 A1 2/2010 Zhong
2010/0166569 A1 7/2010 Andy

FOREIGN PATENT DOCUMENTS

GB 2487623 A 1/2012
JP 2006029222 A 2/2006
JP 2006258076 A 9/2006
WO 2008/143859 A1 11/2008

OTHER PUBLICATIONS

Office Action dated Sep. 11, 2015, in corresponding Japanese application No. 2014548933.
Office Action, dated Mar. 31, 2016. in corresponding Chinese application No. 201280063196.8.
Office Action for corresponding Russian Application No. 2014130007, dated Oct. 3, 2016, with English translation.
EPC Communication pursuant to Article 94(3) dated Jun. 26, 2018, in the corresponding European application No. 12816201.3.

* cited by examiner

METHOD FOR CONTROLLING A PUMP ARRANGEMENT

TECHNICAL FIELD OF THE INVENTION

The present invention relates generally to a method for controlling a pump arrangement comprising a pump and a control unit, the pump comprising a motor and the control unit being arranged to drive said motor. In particular, the present invention relates to a method for controlling a pump arrangement, said motor, at each individual instant of time, when the pump is in an active state and the motor is driven in a first direction, being associated with a load factor that corresponds to an instantaneous operating condition of the pump arrangement, the pump arrangement furthermore comprising means for monitoring at least one operating parameter from which the load factor of the motor can be derived.

BACKGROUND OF THE INVENTION AND PRIOR ART

In the pumping of liquid, such as waste water comprising solid matter, by means of, for instance, a submersible pump, the solid matter will sooner or later adversely affect the capacity of the pump to transport liquid. The solid matter is caught in the hydraulic unit of the pump and adheres slowly to the impeller of the pump as well as to the inside of the pump housing of the pump, and thereby the hydraulic efficiency of the pump is adversely affected and the pump will operate in a strained operating condition as a consequence of increased rotation resistance, increased moment of inertia, and impaired hydraulic properties. At present, there are several known methods for more or less automatic cleaning of a pump when the pump, or more precisely the hydraulic unit of the pump, begins clogging. The strained operating condition is not detrimental to the pump, but a higher current consumption and inferior pump performance are obtained, which is expensive for the plant owner and which may involve adverse consequences such as flooded pump station when the available capacity of the pump is not enough for emptying the pump station.

Known cleaning methods, or methods for controlling a pump arrangement, are relatively rough and lack capacity to analyse the load factor of the motor and what consequences different load factors may have. Known cleaning methods detect that cleaning is required and then carry out a predetermined standard cleaning sequence, which at least involves that the motor of the pump is braked by the fact that the rotational speed of the motor is subjected to an extended, predetermined down-ramping driven by the control unit. It is known that it is not wanted/recommended to stop the motor of the pump abruptly, above all because of requirements to avoid so-called water hammer in the pipe system downstream the pump, but also because of the large moment of inertia and the large momentum possessed by the impeller of the pump in normal operation. If the motor is stopped abruptly, water hammer arises inevitably where the kinetic energy of the liquid and moment of inertia in the pipe conduits downstream the pump create vibrations that risk destroying the pipe conduits and other engineering components, and moreover, the risk is imminent that the impeller comes loose, the drive shaft of the pump is damaged, etc. Thus, an extended, controlled down-ramping of the rotational speed of the motor always takes place.

A direct consequence of the lack of intelligence of the cleaning method is that the standard cleaning sequence used, and which is adequate in strained operating conditions as described above, drastically increases the load factor of the pump when a large and/or hard object enters the hydraulic unit of the pump and is wedged up, i.e., when an operating condition detrimental to the pump arrangement has arisen. With detrimental operating condition, reference is made to an operating condition that immediately or in the short term will cause the pump and/or the control unit to break. When the control unit, for instance in the form of a frequency converter (VFD), carries out said down-ramping when a large and/or hard object has wedged and mechanically brakes the impeller, the extended, controlled down-ramping causes the motor to force the impeller to rotate and the object is wedged harder/more severe. This causes in turn the impeller, drive shaft, motor, etc., of the pump or the control unit to become overworked and damaged.

In order to prevent the pump and/or the control unit from being damaged, various security systems/protective equipment are used today, such as protective motor switches, fuses, etc., which are arranged to protect the equipment and be triggered before the equipment is damaged. Common to the detrimental operating conditions described above, i.e., if security systems are triggered and/or if the pump arrangement breaks, it is required that service staff makes an emergency turn-out and attends to the error/clogging. These turnouts are expensive per se and, moreover, an inoperative pump is expensive for the plant owner.

BRIEF DESCRIPTION OF THE OBJECTS OF THE INVENTION

The present invention aims at obviating the above-mentioned disadvantages and failings of previously known cleaning methods and at providing an improved method for controlling a pump arrangement. A primary object of the invention is to provide an improved method for controlling a pump arrangement of the type defined by way of introduction, which analyses the load factor of the motor and acts differently depending on the instantaneous operating condition.

Another object of the present invention is to provide a method for controlling a pump arrangement, which almost completely prevents the need of emergency turn-outs by service staff.

BRIEF DESCRIPTION OF THE FEATURES OF THE INVENTION

According to the invention, at least the primary object is achieved by means of the method defined by way of introduction and having the features defined in the independent claims. Preferred embodiments of the present invention are furthermore defined in the depending claims.

According to a first aspect of the present invention, a method for controlling a pump arrangement of the type defined by way of introduction is provided, which is characterized in that the same comprises the steps of:

- determining a real value of said at least one operating parameter, when the pump is in said active state,
- based on said real value of said at least one operating parameter, determining if an externally applied force is acting on the motor to such an extent that an operating condition detrimental to the pump arrangement is initiated, which is true when the load factor of the motor exceeds a level detrimental to the pump arrangement,
- effecting a state shift from the active state of the pump to an inactive state of the pump if an operating condition detrimental to the pump arrangement is initiated, said state shift comprising the step of the control unit, immediately after it is determined that an operating condition detrimental to the pump arrangement is initiated, abruptly breaking the driving of the motor in said first direction.

Thus, the present invention is based on the understanding that by carrying out different types of measures depending on the load factor of the motor, the pump arrangement is spared and the number of emergency service turn-outs can more or less be entirely eliminated.

According to a preferred embodiment of the present invention, the method also comprises the steps of:

based on said real value of said at least one operating parameter, determining if an external force is acting on the motor to such an extent that an operating condition straining the pump arrangement is initiated, which is true when the load factor of the motor exceeds a level straining the pump arrangement, and effecting a state shift from the active state of the pump to a cleaning state of the pump if an operating condition straining the pump arrangement is initiated.

In this way, the pump arrangement will be differently controlled depending on if the character of clogging corresponds to a detrimental operating condition and a strained operating condition, respectively.

According to a preferred embodiment of the present invention, the method also comprises the step of:

effecting a state shift from the active state of the pump to a cleaning state of the pump if the motor continually has been driven in said first direction during a predetermined second period of time ($T_2$).

In this way, a cleaning is obtained for removing clogging that is not sufficiently severe for a strained operating condition to be detected, but none the less affects the hydraulic properties of the pump adversely.

Additional advantages and features of the invention are seen in the other dependent claims as well as in the following, detailed description of preferred embodiments.

BRIEF DESCRIPTION OF THE DRAWINGS

A more complete understanding of the above-mentioned and other features and advantages of the present invention will be evident from the following, detailed description of preferred embodiments, reference being made to the accompanying drawings, wherein.

DETAILED DESCRIPTION OF PREFERRED EMBODIMENTS

Figure 1:
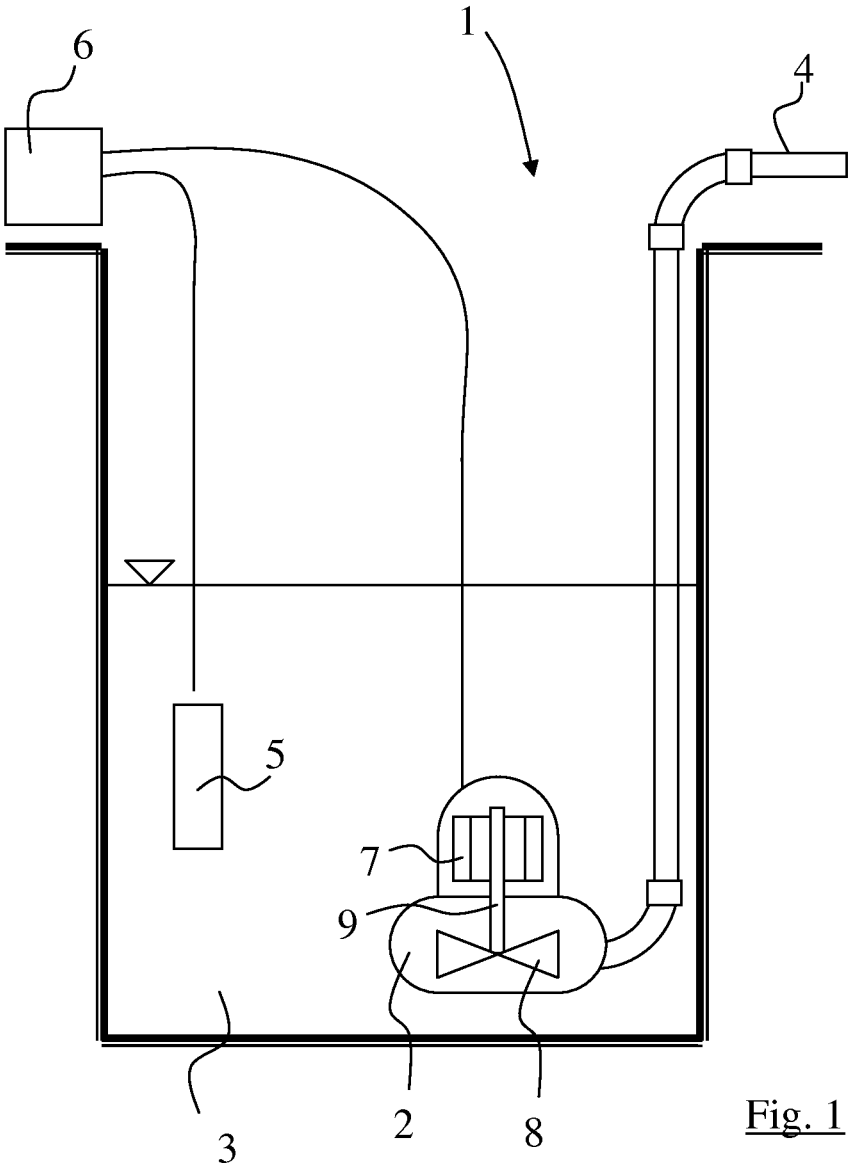
FIG. 1 is a schematic illustration of a pump station.

In FIG. 1, a pump station, generally designated 1 is shown, comprising at least one speed controlled pump 2, usually two submersible pumps, arranged to pump liquid from a sump 3 included in the pump station 1 to an outlet pipe 4 and further away from the pump station 1. Furthermore, in a conventional way, the pump station 1 comprises at least one level instrument 5 arranged to determine the liquid level in the pump station 1. It should be pointed out that the level instrument 5 may be a separate device that is operatively connected to an external control unit 6, be operatively connected to said at least one speed controlled pump 2, be built-in in said at least one speed controlled pump 2, etc. Said at least one speed controlled pump 2 is preferably operatively connected to the external control unit 6 with the purpose of allowing regulation of the rotational speed of the pump, alternatively, said at least one speed controlled pump 2 may comprise a built-in control unit (not shown). Hereinbelow, the denomination control unit 6 will be used independently of the physical location of the same.

Together, the pump 2 and the control unit 6 form at least one part of a pump arrangement, wherein the pump 2 comprises an electric motor 7, which is arranged to be driven by said control unit 6, and an impeller 8, which is connected to the motor 7 via a drive shaft 9 in a conventional way.

With the wording "speed controlled", all feasible ways to change the rotational speed of a pump, or more precisely the rotational speed of the motor 7, are embraced, above all, reference is made to current feed frequency control by means of a frequency converter (VFD), which is built-in in a pump or which is external, and which is an example of said control unit 6, the rotational speed being proportionate to the current feed frequency. However, internally or externally controlled supply voltage control, internal mechanical brake that preferably acts on the drive shaft of the pump, etc., is also intended. Thus, on a comprehensive level of the invention, it is not central how the rotational speed of the pump is regulated, only that the rotational speed of the pump 2 can be regulated/controlled.

The method according to the invention is aimed at controlling a pump arrangement that comprises a pump 2 having a motor 7 and a control unit 6, with the purpose of obtaining adapted cleaning based on the instantaneous operating condition of the pump 2. In this connection, the pump station 1 should be seen as a delimited plant to which incoming liquid arrives and from which outgoing liquid is pumped. The pump station should, as regards the present invention, be regarded irrespective of the type of liquid and irrespective from where the liquid comes and where the liquid should be pumped. In the case when the pump station comprises a plurality of pumps 2, a suitable alternation may take place between them, which however is not handled herein.

Figure 2:
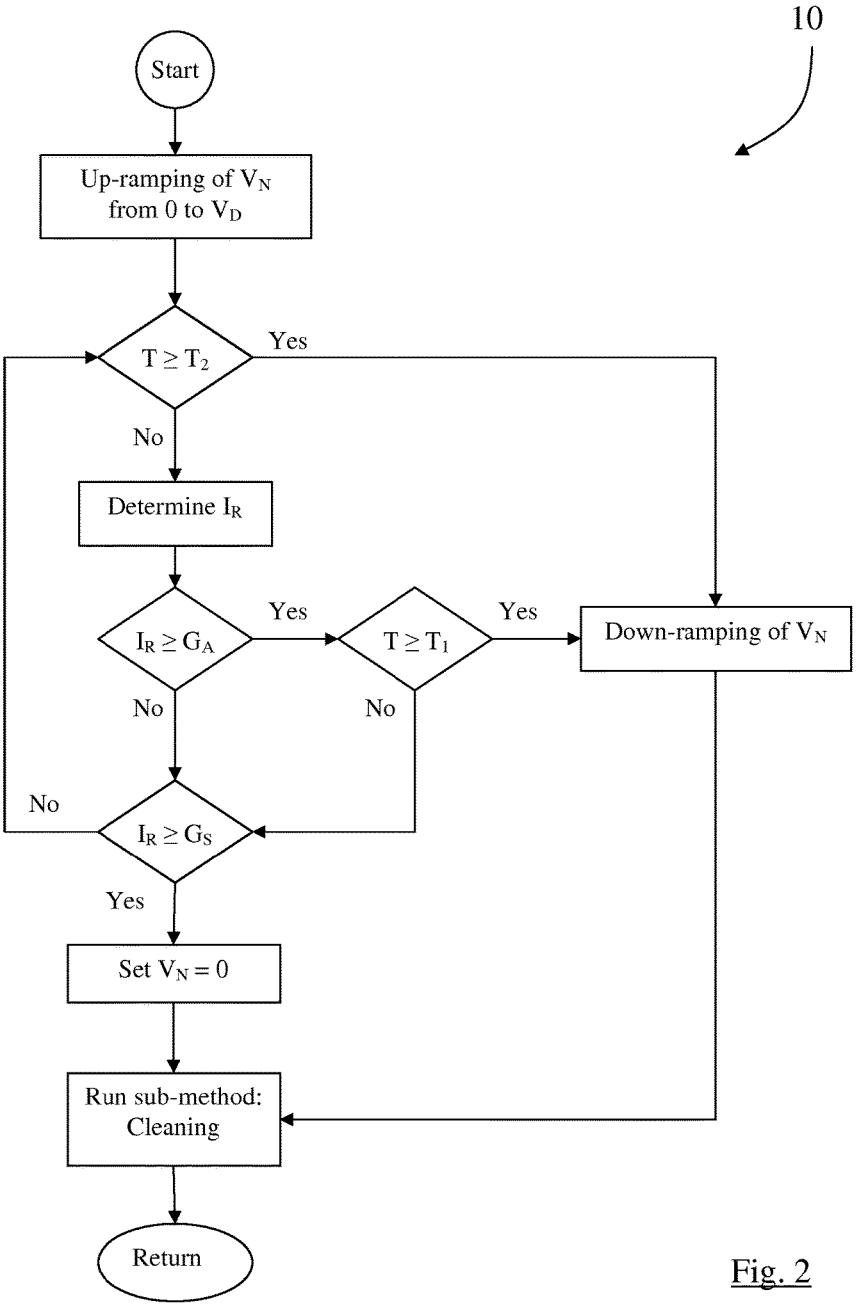
FIG. 2 is a flow chart showing a preferred embodiment of the method according to the invention.

In FIG. 2, there is shown a preferred embodiment of a method, generally designated 10, for controlling a pump arrangement comprising a pump 2 and a control unit 6. It should be pointed out that the method 10 according to the invention can be expanded using one or more sub-methods, and/or be run in parallel with other control methods.

The method 10 according to the invention for controlling a pump arrangement is in practice a cleaning method for a pump, which is entirely or partly clogged. The extent of clogging and/or the character of clogging create a load on the motor 7 of the pump 2 and indicate an operating condition of the pump arrangement. Thus, at each individual instant of time, when the pump 2 is in an active state and the motor 7 is driven in a first direction by the control unit 6, the motor 7 is associated with a load factor that corresponds to an operating condition of the pump arrangement. The pump arrangement also comprises means for, intermittently or continuously, monitoring at least one operating parameter (OP) from which the load factor, torque, and rotational speed of the motor 7 can be derived, either by direct measurement or by derivation from a measurement of another operating parameter/quantity. Said operating parameter (OP) is, for instance, current consumption (I), power consumption (P), torque (M), rotational speed (RPM), etc., or combinations thereof. In reality, the load factor of the motor 7 will be changed, which means that torque and rotational speed are changed, when the hydraulic unit of the pump 2 is entirely or partly clogged. A direct effect of this is that the current consumption, power consumption etc., of the pump are changed to the corresponding extent, wherein the load factor of the motor 7 can be derived from, for instance, the current consumption of the motor. Preferably, the real current consumption $I_R$ of the pump 2, or more precisely of the motor 7, is monitored when the pump 2 is in the above-mentioned active state, and hereinbelow, the invention will be described using this as a starting point. However, it will be appreciated that the invention is not limited to the measurement of current consumption as operating parameter.

Now, the method 10 according to the invention in its most fundamental form will be described in connection with FIGS. 2 and 4.

The method 10 presupposes that the pump 2 is in its active state and the motor 7 is driven in a first direction by the control unit 6. In this connection and in normal operation, said first direction is the direction that makes the impeller 8 to transport liquid from the sump 3 to the outlet pipe 4, i.e., the motor 7 is driven in the forward direction. In the start of the pump 2, i.e., originating from an inactive state of the pump 2, the control unit 6 provides for a controlled, for instance linear, up-ramping of the nominal rotational speed ($V_N$) of the motor 7 from 0 to a predetermined operating speed ($V_D$) that, for instance, is approximately 75-85% of the so-called maximum rotational speed ($V_{MAX}$) of the motor 7. The maximum rotational speed of the motor 7 is the rotational speed the motor 7 has if the pump 2 would be directly connected to a grid (i.e., usually a current feed frequency of 50 Hz or 60 Hz). The operating speed ($V_D$) may, for instance, be a manually set value or an automatically optimized value based on instantaneous energy consumption, etc.

When the pump 2 is in said active state, the method 10 comprises the step of determining a real value of said at least one operating parameter; in the described embodiment, real current consumption ($I_R$) is determined. The real current consumption ($I_R$) varies during normal operation around a nominal value of the current consumption ($I_N$) because of solid material found in the pumped liquid entering, affecting and being transported through the hydraulic unit of the pump 2 and thereby instantaneously impacting the load factor of the motor 7.

Next, the step occurs of determining, based on said real value of said at least one operating parameter, if an externally applied force is acting on the motor 7 to such an extent that an operating condition detrimental to the pump arrangement is initiated, which is true when the load factor of the motor 7 exceeds a level detrimental to the pump arrangement 7. With detrimental operating condition, reference is made to an operating condition that immediately or in the short term will cause the pump 2 and/or the control unit 6 to become overworked and break down upon unaltered driving of the motor 7, alternatively will cause the security system/protective equipment to trig. A detrimental operating condition is imminent when a large and/or hard object enters the hydraulic unit of the pump 2 and is wedged between the impeller 8 and the pump housing. Examples of how the step of determining if an externally applied force is acting on the motor 7 are presented below.

Next, the step occurs of effecting a state shift from the active state of the pump 2 to an inactive state of the pump 2 if an operating condition detrimental to the pump arrangement is initiated, said state shift in turn comprising the step of the control unit 6, immediately after it is determined that an operating condition detrimental to the pump arrangement is initiated, abruptly breaking the driving of the motor 7 in said first direction. The feature to abruptly break the driving is realised by the nominal rotational speed ($V_N$) of the motor 2 being set equal to 0 in the control unit 6, i.e., no down-ramping of the rotational speed of the motor 7 takes place, or by the nominal rotational speed ($V_N$) of the motor 2 being set equal to 0 by disengagement of the motor 7, i.e., the motor 7 being made entirely currentless. This entails that the foreign object, which has entered the hydraulic unit of the pump 2 and been wedged, is not wedged harder/more severe.

Figure 4:
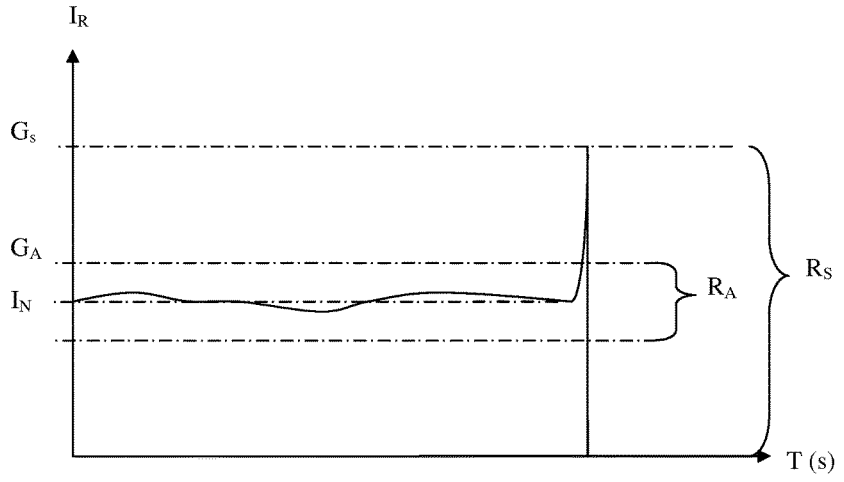
FIG. 4 is a diagram that schematically shows how the current consumption I is changed over time T, and when a detrimental operating condition has been detected.

In the preferred embodiment, shown in FIG. 4, the step of determining if an external force is acting on the motor 7 to such an extent that an operating condition detrimental to the pump arrangement 1 is initiated comprises the step of determining if said real value of said at least one operating parameter (OP) is equal to or exceeds a predetermined detrimental threshold value ($G_S$). In other words, it is checked whether the real current consumption $I_R$ is equal to or exceeds a predetermined detrimental threshold value ($G_S$) of the current consumption. Preferably, the value of said detrimental threshold value ($G_S$) is 70-90%, most preferably 75-85%, greater than the nominal value of the operating parameter, e.g., the nominal current consumption ($I_N$).

Figure 8:
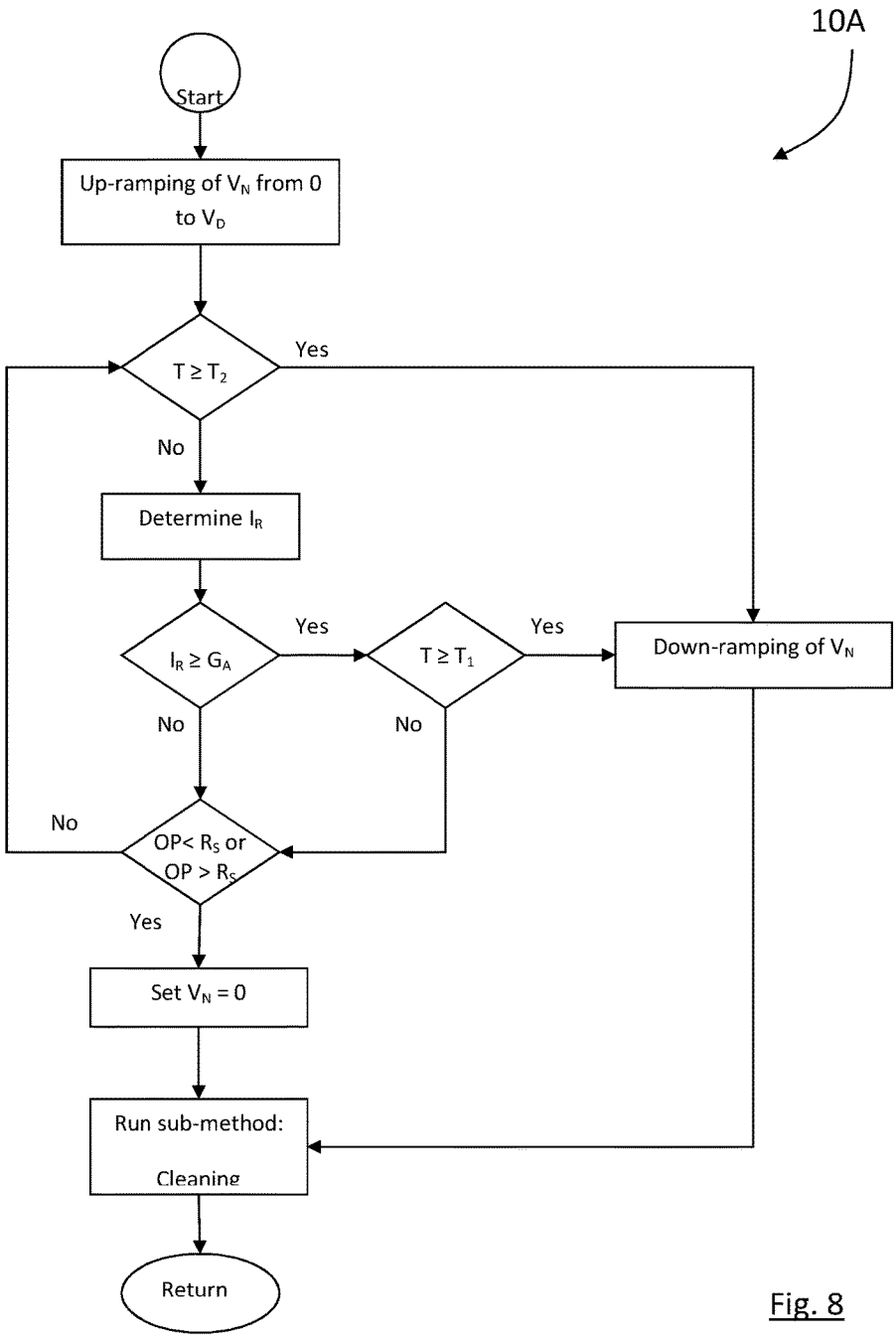
FIG. 8 is a flow chart showing another embodiment of the method according to the invention.

According to an alternative embodiment shown in FIG. 8, the step of determining if an external force is acting on the motor 7 to such an extent that an operating condition detrimental to the pump arrangement 1 is initiated comprises instead the step of determining if said real value of said at least one operating parameter (OP) is outside a predetermined detrimental interval ($R_S$). Said detrimental interval ($R_S$) may be equilaterally as well as inequilaterally distributed around the nominal value of the operating parameter, e.g., the nominal current consumption ($I_N$).

Figure 9:
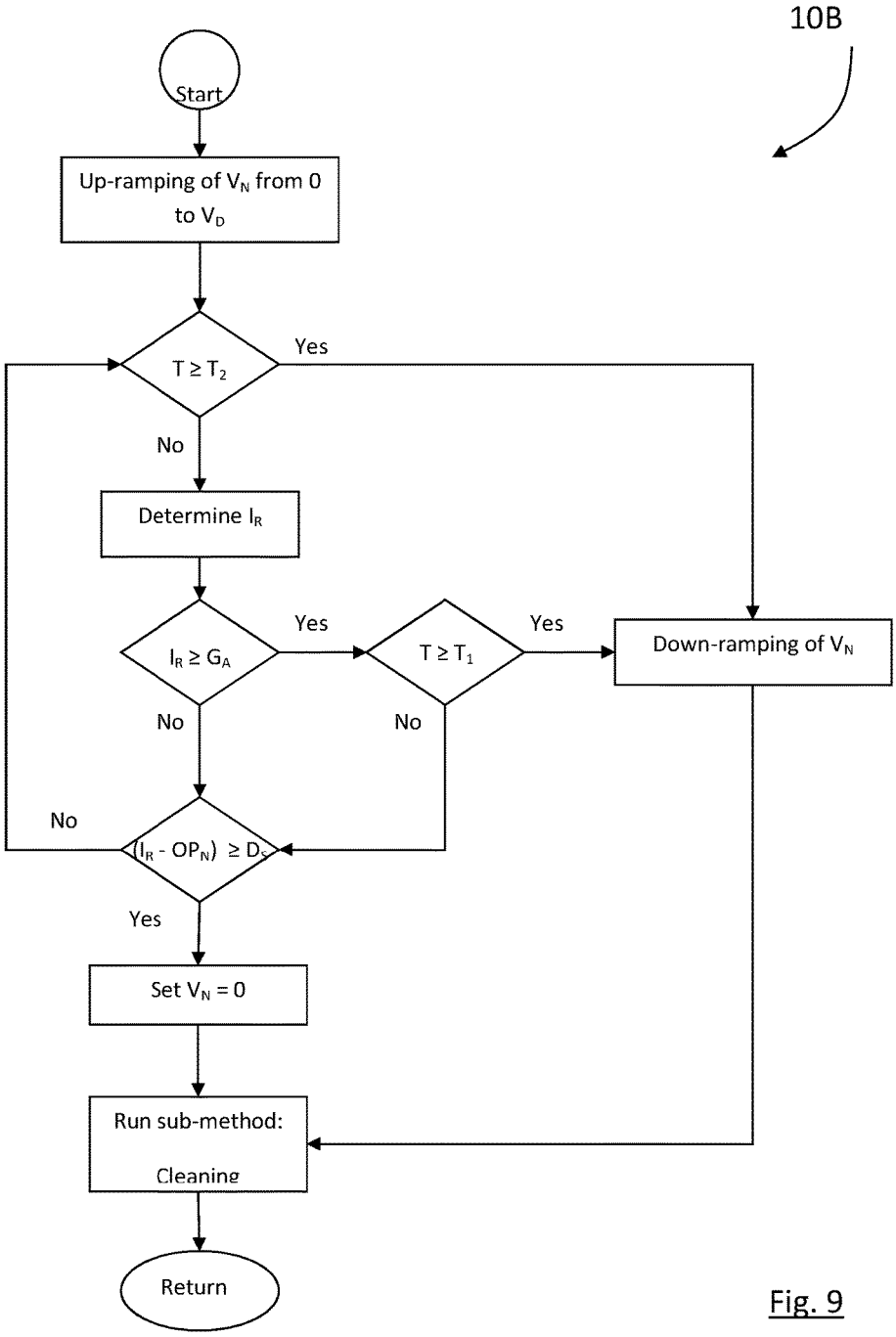
FIG. 9 is a flow chart showing yet another embodiment of the method according to the invention.

According to a further alternative embodiment shown in FIG. 9, the step of determining if an external force is acting on the motor 7 to such an extent that an operating condition detrimental to the pump arrangement 1 is initiated comprises instead the step of determining if a difference between said real value and a predetermined nominal value of the operating parameter ($OP_N$), when the pump 2 is in an active state, is equal to or exceeds a predetermined detrimental difference threshold value ($D_S$). In the described embodiment, the difference is determined between the real current consumption ($I_R$) and the nominal current consumption ($I_N$).

Figure 5:
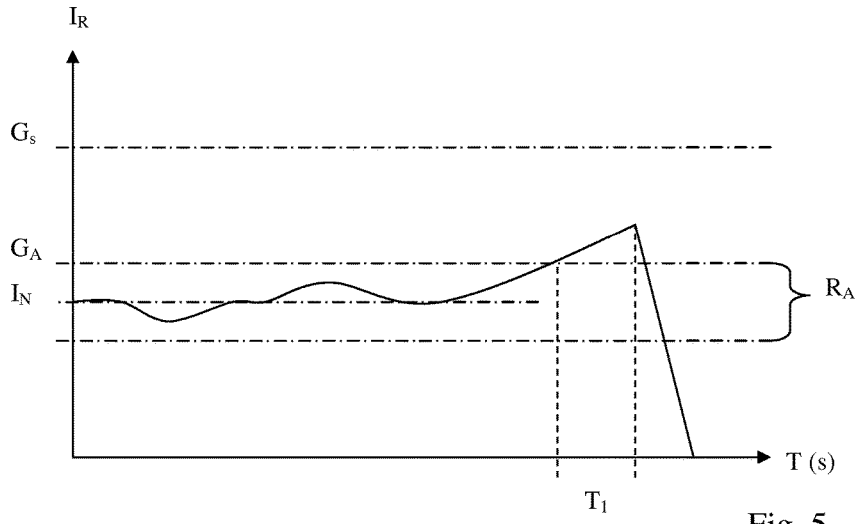
FIG. 5 is a diagram corresponding to the one shown in FIG. 4, when a strained operating condition of a first type has been detected.
Figure 6:
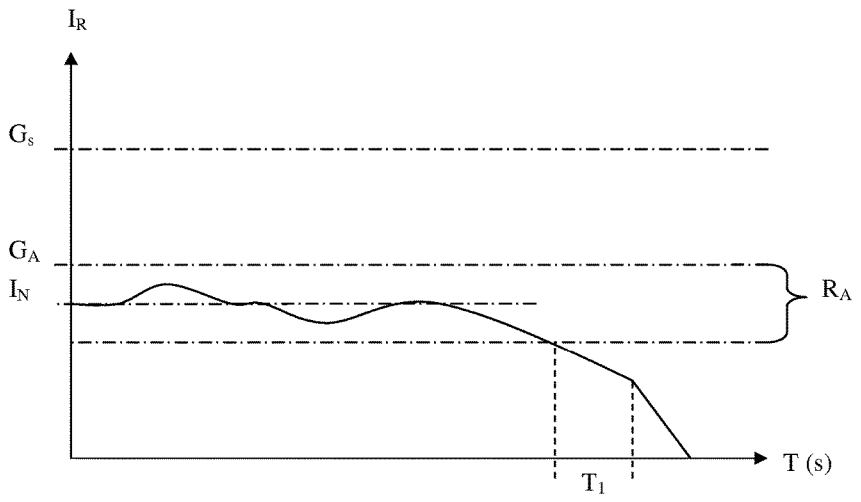
FIG. 6 is a diagram corresponding to the one shown in FIG. 5, when a strained operating condition of a second type has been detected.

Reference is once again made primarily to FIG. 2, in combination with FIGS. 5 and 6. The method 10 according to the invention comprises preferably also the step of determining, based on said real value of said at least one operating parameter, if an external force is acting on the motor 7 to such an extent that an operating condition straining the pump arrangement 1 is initiated, which is true when the load factor of the motor 7 exceeds a level straining the pump arrangement 1, and the step of effecting a state shift from the active state of the pump 2 to a cleaning state of the pump 2 if an operating condition straining the pump arrangement 1 is initiated. With a strained operating condition, reference is made to an operating condition that relatively slowly gives rise to a higher current consumption and impaired pump performance/impaired hydraulic properties, wherein the pump 2 and/or the control unit 6 will be unnecessarily strained. A strained operating condition is imminent when solid matter is caught in the hydraulic unit of the pump and slowly adheres to the impeller of the pump 2 as well as to the inside of the pump housing of the pump 2, see FIG. 5. Alternatively, a strained operating condition is imminent when the inlet of the pump 2 entirely or largely is plugged up by a large object that does not enter the hydraulic unit of the pump 2 and thereby prevents liquid flow into the pump 2, see FIG. 6. Examples of how the step of determining if an externally applied force is acting on the motor 7 are presented below.

Said state shift from the active state of the pump 2 to the cleaning state of the pump 2 comprises preferably the step of decreasing the rotational speed of the motor 7 in said first direction according to a predetermined controlled, for instance linear, down-ramping of the nominal rotational speed ($V_N$) of the motor 7 to 0.

In the preferred embodiment, shown in FIG. 5, the step of determining if an external force is acting on the motor 7 to such an extent that an operating condition straining the pump arrangement 1 is initiated comprises the step of determining if said real value of said at least one operating parameter is equal to or exceeds a predetermined straining threshold value ($G_A$) during a predetermined first period of time ($T_1$). In other words, it is checked whether the real current consumption ($I_R$) is equal to or exceeds a predetermined straining threshold value ($G_A$) of the current consumption during a predetermined period of time, which preferably is longer than 5 s. Preferably, the value of said strained threshold value ($G_A$) is 10-30%, most preferably 15-25%, greater than the nominal value of the operating parameter, e.g., the nominal current consumption ($I_N$).

Figure 10:
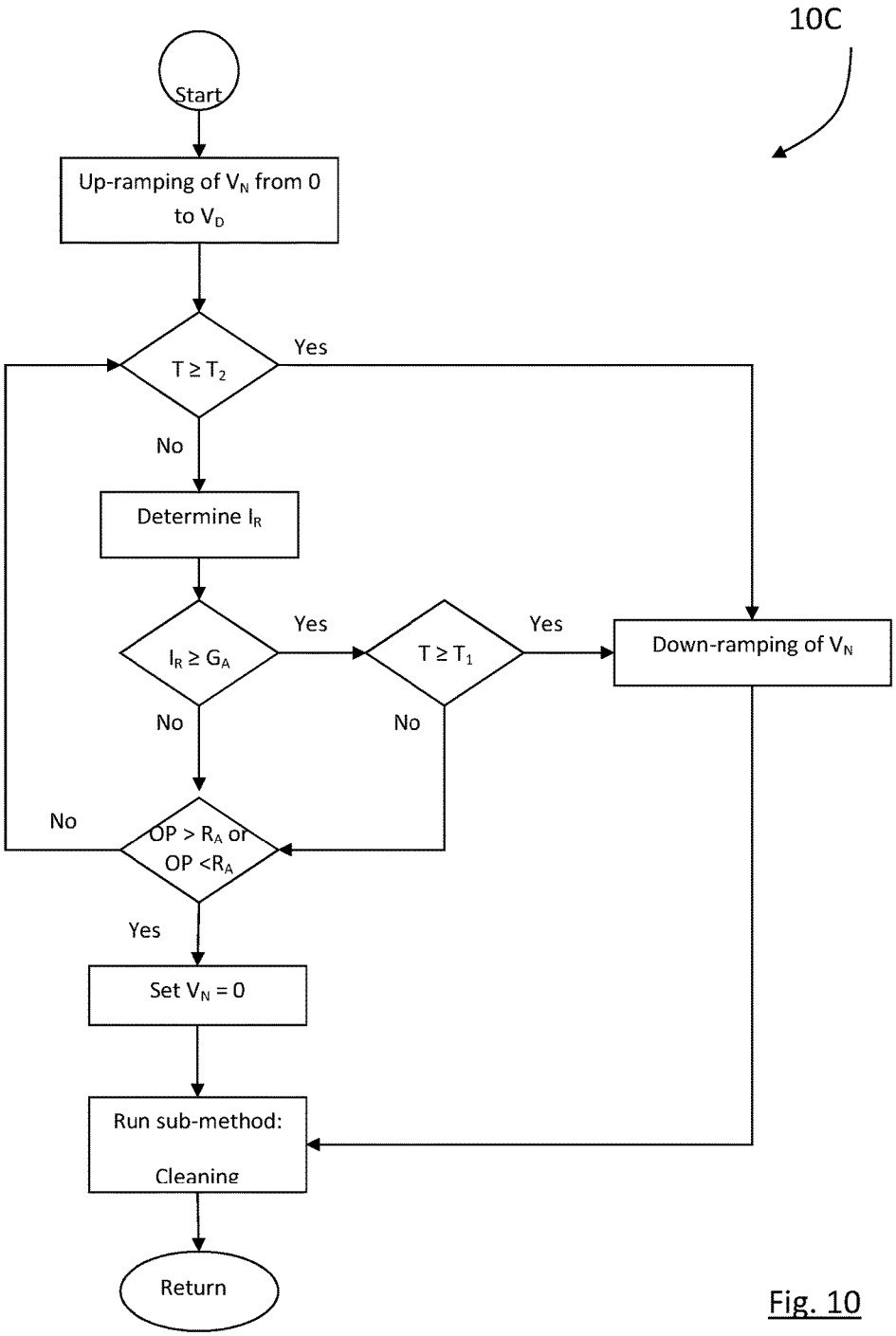
FIG. 10 is a flow chart showing still another embodiment of the method according to the invention.

According to an alternative embodiment shown in FIG. 10, the step of determining if an external force is acting on the motor 7 to such an extent that an operating condition straining the pump arrangement 1 is initiated comprises instead the step of determining if said real value of said at least one operating parameter (OP) is outside a predetermined straining interval ($R_A$) during a predetermined first period of time ($T_1$). Said straining interval ($R_A$) may be equilaterally as well as inequilaterally distributed around the nominal value of the operating parameter, e.g., the nominal current consumption ($I_N$).

Figure 11:
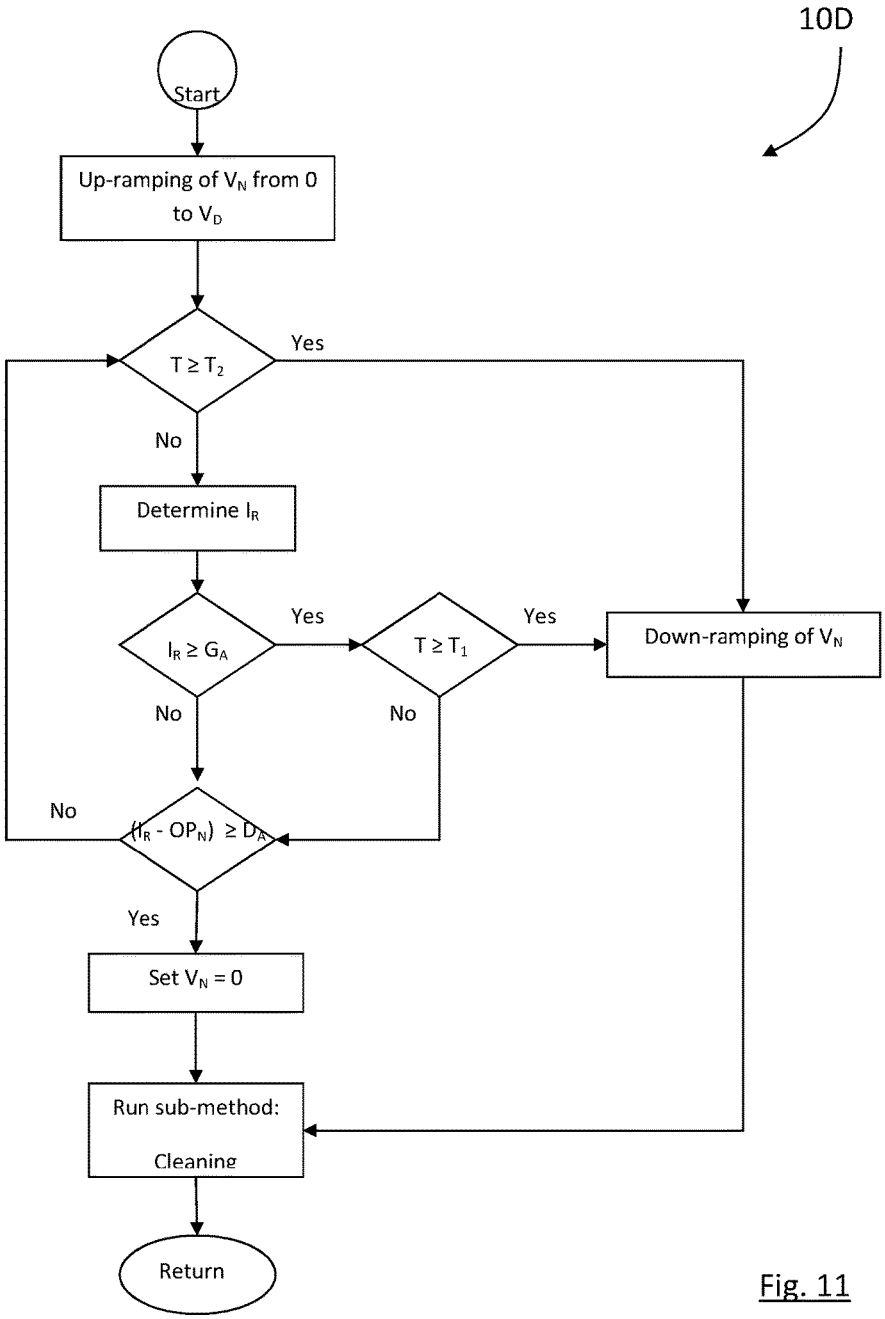
FIG. 11 is a flow chart showing still another embodiment of the method according to the invention.

According to a further alternative embodiment shown in FIG. 11), the step of determining if an external force is acting on the motor 7 to such an extent that an operating condition straining the pump arrangement 1 is initiated comprises instead the step of determining if a difference between said real value and a predetermined nominal value of the operating parameter ($OP_N$), when the pump 2 is in an active state, is equal to or exceeds a predetermined straining difference threshold value ($D_A$) during a predetermined first period of time ($T_1$). In the described embodiment, the difference is determined between the real current consumption ($I_R$) and the nominal current consumption ($I_N$).

In those cases when the method 10 comprises detection of a detrimental operating condition as well as a strained operating condition, the threshold value ($G_S$) detrimental to said at least one operating parameter should be at least 20% greater than the threshold value ($G_A$) straining said at least one operating parameter. Alternatively, the interval ($R_S$) detrimental to said at least one operating parameter should be greater than and include the interval ($R_A$) straining said at least one operating parameter. Further alternatively, the difference threshold value ($D_S$) detrimental to said at least one operating parameter should be at least two times greater than the difference threshold value ($D_A$) straining said at least one operating parameter.

Figure 7:
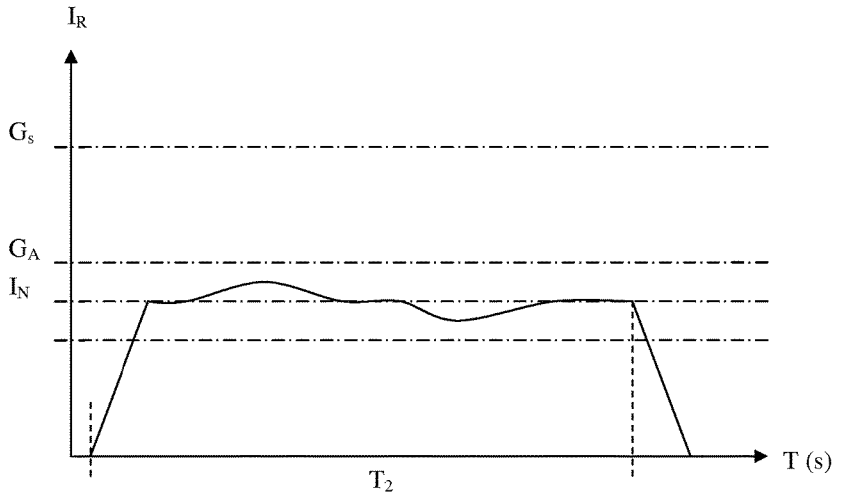
FIG. 7 is a diagram corresponding to the one shown in FIG. 4, when a time-based cleaning need has been detected.

Reference is once again made primarily to FIG. 2, in combination with FIG. 7. The method 10 according to the invention comprises preferably also the step of effecting a state shift from the active state of the pump 2 to a cleaning state of the pump 2 if the motor 7 continually has been driven in said first direction during a predetermined second period of time ($T_2$). In other words, the pump 2 should at regular intervals undergo a cleaning even if strained or detrimental clogging has not been detected. Said state shift from the active state of the pump 2 to the cleaning state of the pump 2 comprises preferably the step of decreasing the rotational speed of the motor 7 in said first direction according to a predetermined controlled, for instance linear, down-ramping of the nominal rotational speed ($V_N$) of the motor 7 to 0.

Figure 3:
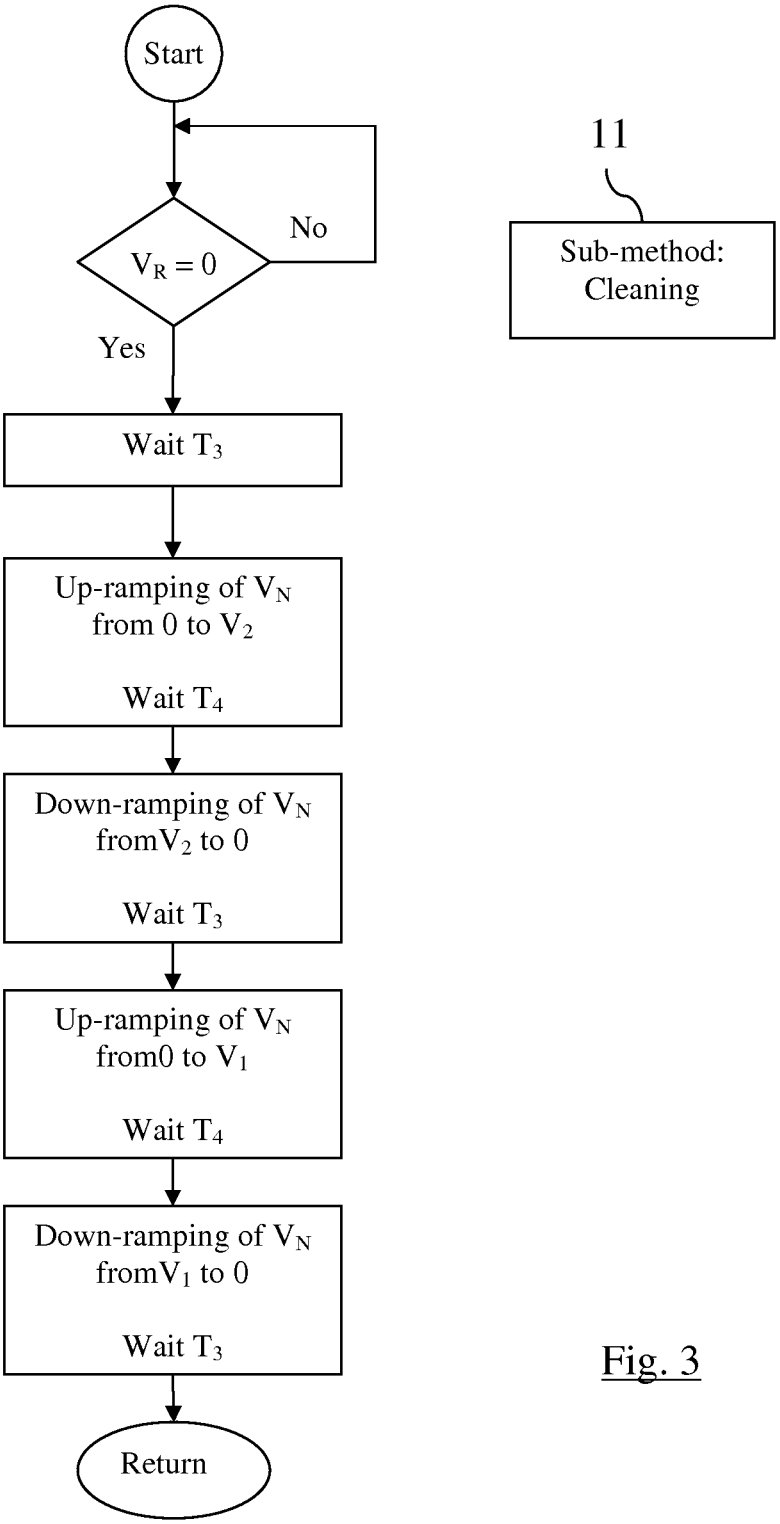
FIG. 3 is a flow chart showing the sub-method "Cleaning"

Reference is now made essentially to FIG. 3. In conclusion of the method 10 according to the invention, a sub-method is carried out that generally is designated 11 and goes under the denomination Cleaning. It should be mentioned that the method 10 according to the invention may comprise different types of sub-methods coupled to cleaning, based on if a detrimental or strained operating condition, respectively, have been detected. Hereinbelow, however, one and the same sub-method 11 is described.

The sub-method 11 comprises the steps of stopping the motor 7, and keeping the motor 7 stopped during a predetermined third period of time ($T_3$). In this way, an automatic backwash of the hydraulic unit of the pump 2 is obtained, whereupon the solid matter possibly is flushed out of the pump 2.

Furthermore, the sub-method 11 preferably comprises the steps of increasing the nominal rotational speed ($V_N$) of the motor 7 from 0 to a second cleaning rotational speed ($V_2$) in a second direction opposite the first direction according to a predetermined up-ramping of the rotational speed of the motor 7, driving the motor 7 in said second direction during a predetermined fourth period of time ($T_4$), decreasing the nominal rotational speed ($V_N$) of the motor 7 from said second cleaning rotational speed ($V_2$) in said second direction to 0 according to a predetermined down-ramping of the rotational speed of the motor 7, and keeping the motor 7 stopped during said predetermined third period of time ($T_3$). In this way, an increased turbulence is obtained in the hydraulic unit of the pump 2, which causes solid matter to come loose and be pumped rearward out of the pump 2; in addition, the effect is obtained that large and/or hard objects that are caught in the hydraulic unit of the pump 2 will be worked loose.

Next, the sub-method 11 preferably comprises the steps of increasing the nominal rotational speed ($V_N$) of the motor 7 from 0 to a first cleaning rotational speed ($V_1$) in the first direction according to a predetermined up-ramping of the rotational speed of the motor 7, driving the motor 7 in said first direction during the predetermined fourth period of time ($T_4$), decreasing the nominal rotational speed ($V_N$) of the motor 7 from said first cleaning rotational speed ($V_1$) in said first direction to 0 according to a predetermined down-ramping of the rotational speed of the motor 7, and keeping the motor 7 stopped during said predetermined third period of time ($T_3$). In this way, a further increased turbulence in the hydraulic unit of the pump 2 is obtained, which causes solid matter to come loose and be pumped out of the pump 2; in addition, an enhanced effect is obtained in that large and/or hard objects that are caught in the hydraulic unit of the pump 2 will be worked loose.

Said up-rampings are preferably controlled, for instance linear, up-rampings of the nominal rotational speed ($V_N$) of the motor 7 from 0 to the predetermined second cleaning rotational speed ($V_2$) in said second direction and to the predetermined first cleaning rotational speed ($V_1$) in said first direction, respectively. Furthermore, said down-rampings are preferably controlled, for instance linear, down-rampings of the nominal rotational speed ($V_N$) of the motor 7 from the predetermined second cleaning rotational speed ($V_2$) in the second direction and from the predetermined first cleaning rotational speed ($V_1$) in the first direction, respectively, to 0. The magnitude of the first cleaning rotational speed ($V_1$) is preferably equal to the maximal rotational speed ($V_{MAX}$) of the motor 7, and the magnitude of the second cleaning rotational speed ($V_2$) is preferably equal to 80% of the maximal rotational speed ($V_{MAX}$) of the motor. Said third period of time ($T_3$) and said fourth period of time ($T_4$) are preferably longer than 5 s each.

Feasible Modifications of the Invention

The invention is not limited only to the embodiments described above and shown in the drawings, which only have the purpose of illustrating and exemplifying. This patent application is intended to cover all adaptations and variants of the preferred embodiments described herein, and consequently the present invention is defined by the wording of the accompanying claims and the equivalents thereof. Accordingly, the equipment may be modified in all feasible ways within the scope of the accompanying claims.

It should be pointed out that even if it is not explicitly mentioned that features from one specific embodiment can be combined with the features of another embodiment, this should be regarded as evident when possible.

Throughout this specification and in the subsequent claims, unless the context indicates something different, it will be appreciated that the word "comprise", and variants such as "comprises" or "comprising", means inclusion of indicated unit or step or group of units or steps but not exclusion of other units or steps or groups of units or steps.

The invention claimed is:

1. A method for controlling a pump arrangement comprising a pump (2) and a controller (6), the pump (2) comprising a motor (7) and the controller (6) being arranged to drive said motor (7), wherein said motor (7), at each individual instant of time, when the pump (2) is in an active state and the motor (7) is driven in a first direction, has a load factor that corresponds to an operating condition of the pump arrangement, the method comprising the steps of:

monitoring at least one operating parameter from which the load factor is derived;

determining a real value of said at least one operating parameter, when the pump (2) is in said active state, determining, using said real value of said at least one operating parameter, if an externally applied force is acting on the motor (7) to such an extent that one of a plurality of operating conditions of the pump arrangement is initiated when the load factor of the motor (7) exceeds a level such that continued operation will cause the pump to break, and effecting a state shift from the active state of the pump (2) to an inactive state of the pump (2) if said one of the plurality of operating conditions is initiated, wherein said state shift comprises the step of causing the controller (6), immediately after it is determined that said one of the plurality of operating conditions is initiated, to abruptly break the driving of the motor (7) in said first direction by a nominal rotational speed of the motor (7) being set equal to zero in the controller (6).

2. The method according to claim 1, wherein the step of determining, using said real value of said at least one operating parameter, if the externally applied force is acting on the motor (7), comprises the step of:

determining if said real value of said at least one operating parameter is equal to or exceeds a predetermined threshold value (GS).

3. The method according to claim 2, wherein another one of the plurality of operating conditions is initiated when based on said real value of said at least one operating parameter, the externally applied force is determined to be acting on the motor (7) to such an extent that when the load factor of the motor (7) exceeds a predetermined level in response to solid matter being caught in the pump or an object being at least partially blocking the pump, and further comprising the step of effecting a state shift from the active state of the pump (2) to a cleaning state of the pump (2) when said another of the plurality of operating conditions is initiated.

4. The method according to claim 1, wherein the step of determining, using said real value of said at least one operating parameter, if the externally applied force is acting on the motor (7), comprises the step of:

determining if said real value of said at least one operating parameter is outside a predetermined interval (RS).

5. The method according to claim 4, wherein another one of the plurality of operating conditions is initiated when based on said real value of said at least one operating parameter, the externally applied force is determined to be acting on the motor (7) to such an extent that when the load factor of the motor (7) exceeds a predetermined level in response to solid matter being caught in the pump or an object being at least partially blocking the pump, and further comprising the step of effecting a state shift from the active state of the pump (2) to a cleaning state of the pump (2) when the another of the plurality of operating conditions is initiated.

6. The method according to claim 5, wherein the externally applied force is determined to be acting on the motor (7) by determining if said real value of said at least one operating parameter is outside a predetermined interval (RA) during a predetermined first period of time (T1).

7. The method according to claim 6, wherein the interval (RS) is greater than and includes the interval (RA).

8. The method according to claim 1, wherein the step of determining, using said real value of said at least one operating parameter, if the externally applied force is acting on the motor (7), comprises the step of:

determining if a difference between said real value and a predetermined nominal value, when the pump (2) is in the active state, is equal to or exceeds a predetermined difference threshold value (DS).

9. The method according to claim 8, wherein another one of the plurality of operating conditions is initiated when based on said real value of said at least one operating parameter, the externally applied force is determined to be acting on the motor (7) to such an extent that when the load factor of the motor (7) exceeds a predetermined level in response to solid matter being caught in the pump or an object being at least partially blocking the pump, and further comprising the step of effecting a state shift from the active state of the pump (2) to a cleaning state of the pump (2) when said another one of the plurality of operating conditions is initiated.

10. The method according to claim 9, wherein the externally applied force is determined to be acting on the motor (7) by determining if a difference between said real value and a predetermined nominal value, when the pump (2) is in the active state, is equal to or exceeds a predetermined difference threshold value (DA) during a predetermined first period of time (T1).

11. The method according to claim 10, wherein the difference threshold value (DS) is at least two times greater than the difference threshold value (DA).

12. The method according to claim 1, which furthermore comprises the step of:

effecting a state shift from the active state of the pump (2) to a cleaning state of the pump (2) if the motor (7) continually has been driven in said first direction during a predetermined period of time (T2).

13. A method for controlling a pump arrangement comprising a pump (2) and a controller (6), the pump (2) comprising a motor (7) and the controller (6) being arranged to drive said motor (7), wherein said motor (7), at each individual instant of time, when the pump (2) is in an active state and the motor (7) is driven in a first direction, has a load factor that corresponds to an operating condition of the pump arrangement, the method comprising the steps of:

monitoring at least one operating parameter from which the load factor is derived;

determining a real value of said at least one operating parameter, when the pump (2) is in said active state, determining, using said real value of said at least one operating parameter, if an externally applied force is acting on the motor (7) to such an extent that one of a plurality of operating conditions of the pump arrangement is initiated when the load factor of the motor (7) exceeds a level such that continued operation will cause the pump to break, and effecting a state shift from the active state of the pump (2) to an inactive state of the pump (2) if said one of the plurality of operating conditions is initiated, wherein said state shift comprises the step of causing the controller (6), immediately after it is determined that said one of the plurality of operating conditions is initiated, to abruptly break the driving of the motor (7) in said first direction by a nominal rotational speed of the motor (7) being set equal to zero in the controller (6), determining that the externally applied force is acting on the motor (7) to such an extent that when the load factor of the motor (7) exceeds a predetermined level in response to solid matter being caught in the pump or an object is at least partially blocking the pump, initiating another one of the plurality of operating conditions when based on said real value of said at least one operating parameter, and effecting a state shift from the active state of the pump (2) to a cleaning state of the pump (2) when the another one of the plurality of operating conditions is initiated.

14. The method according to claim 13, wherein the externally applied force is determined to be acting on the motor (7) by determining if said real value of said at least one operating parameter is equal to or exceeds a predetermined threshold value (GA) during a predetermined first period of time (T1).

15. The method according to claim 14, wherein the externally applied force is determined to be acting on the motor by determining if said real value of said at least one operating parameter is equal to or exceeds a predetermined threshold value (GS), and wherein the predetermined threshold value (GS) is at least 20% greater than the predetermined threshold value (GA).

16. The method according to claim 13, wherein the externally applied force is determined to be acting on the motor (7) by determining if said real value of said at least one operating parameter is outside a predetermined interval (RA) during a predetermined first period of time (T1).

17. The method according to claim 13, wherein the externally applied force is determined to be acting on the motor (7) by determining if a difference between said real value and a predetermined nominal value, when the pump (2) is in the active state, is equal to or exceeds a predetermined difference threshold value (DA) during a predetermined first period of time (T1).

18. The method according to claim 13, wherein said state shift from the active state of the pump (2) to the cleaning state of the pump (2) comprises the step of:

decreasing the rotational speed of the motor (7) in said first direction according to a predetermined down-ramping of the rotational speed of the motor (7).

19. The method according to claim 18, which furthermore comprises the steps of:

stopping the motor (7), and keeping the motor (7) stopped during a predetermined third period of time (T3).

20. The method according to claim 19, which furthermore comprises the steps of:

increasing the rotational speed of the motor (7) in a second direction opposite the first direction according to a predetermined up-ramping of the rotational speed of the motor (7), driving the motor (7) in said second direction during a predetermined fourth period of time (T4), decreasing the rotational speed of the motor (7) in said second direction according to said down-ramping of the rotational speed of the motor (7), and stopping the motor (7).

* * * * *